United States Patent [19]

Bystedt

[11] 4,372,810

[45] Feb. 8, 1983

[54] METHOD AND DEVICE FOR MANUFACTURING MECHANICAL PULP

[75] Inventor: Hjalmar S. I. Bystedt, Enebyberg, Sweden

[73] Assignee: Sunds Defibrator AB, Stockholm, Sweden

[21] Appl. No.: 195,707

[22] Filed: Oct. 9, 1980

[51] Int. Cl.[3] ..... D21B 1/04

[52] U.S. Cl. ..... 162/23; 162/25; 162/26; 162/28; 241/28

[58] Field of Search ..... 162/26, 27, 23, 25, 162/28, 17; 241/28

[56] References Cited

U.S. PATENT DOCUMENTS 3,808,090 4/1974 Logan et al. ..... 162/26

*Primary Examiner*—Peter Chin

*Attorney, Agent, or Firm*—Eric Y. Munson

[57] ABSTRACT

A method and a device for the manufacture of mechanical pulp from lignocellulosic material by forcing the said material into contact with a grinding disc (1) which revolves about a central axle (2) perpendicular to the two end faces of the disc.. The material is supplied in bulk, particulate form, preferably as wood chips, a large number of particles simultaneously being retained, compressed and, in the presence of water, forced into contact with one or more grinding areas (5) on one or both end faces of the grinding disc. The disc is enclosed in a sealed, pressurized housing (6).

8 Claims, 7 Drawing Figures

METHOD AND DEVICE FOR MANUFACTURING MECHANICAL PULP

The present invention is concerned with a method and a device for manufacturing mechanical pulp from lignocellulosic material, whereby the material is forced into contact with at least one grinding area on one or both end faces of a grinding disc which rotates about an axis perpendicular to the end faces of the disc.

The method is a development of that of the corresponding U.S. patent application, Ser. No. 165,120, filed July 1, 1980. The raw material for the latter consists, as in the well-known stone grinding method, of round timber, i.e. whole logs cut to a fixed length. The use of the flat end face of a patterned steel disc instead of the curved surface of a cylindrical grindstone, and the carrying out of the grinding at higher than atmospheric pressure offer advantages which have been set forth in detail in the above-mentioned patent application. The restriction of the method to round timber is, however, a disadvantage from the raw materials point of view, since one cannot, as in the chip refining methods, use sawmill waste such as outside boards, edgings, small pulpwood, very crooked timber etc. Methods hitherto known for the manufacture of mechanical pulp from wood chips are based on the principle of two mutually rotating refining discs. The chips are introduced, nowadays usually under steam pressure, into the gap between the discs, where they are free to move. See, for example, British Patent Specification 1,266,898. The fibres are freed and fibrillated from the wood bond, which is softened by the steam, partly through the action of the two riffled discs and partly through friction between the chip particles during their intense, turbulent motion between the discs. The product is a pulp which is superior to all other industrially produced mechanical pulps in fibre length and strength qualities. Hence a considerable saving of the expensive chemical reinforcing pulp can be achieved in paper making. However, this so-called thermomechanical pulp requires a high energy consumption, and the disc refiner and the refining discs must be fabricated with high precision and stability in order for the large refining discs to perform satisfactorily at the high speed of rotation and with the narrow clearance that are necessary.

A maximum of strength in the mechanical pulp is particularly desirable for newsprint, which is subjected to severe stresses in the fast newsprint machines and in the printing presses. For other paper grades, however, such as multi-colour gravure paper, printing qualities are at least equally important. In such cases one may use a pulp with shorter fibres and a higher fines fraction, which gives a smoother surface and higher opacity than long-fibred pulps.

The purpose of the present invention is to manufacture such a pulp with low energy consumption, avoiding the constructional drawbacks of stone grinding and its restriction to round timber. This is achieved, according to the invention, in that the method and the device are given the characteristics set forth hereafter in the claims.

The invention is further detailed in the claims and in the following description of an embodiment thereof.

Figure 4A:
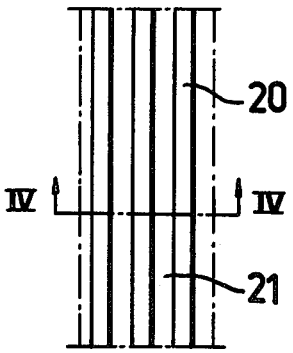
Figure 5A:
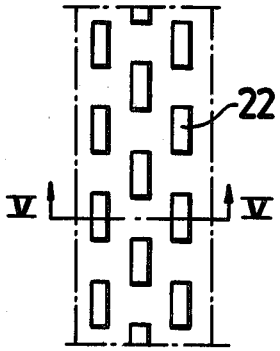
Figure 4B:
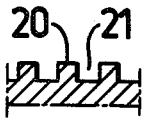
Figure 5B:
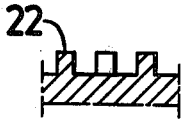

FIGS. 4*a* and 5*a* show different designs of the patterning of the grinding disc, while FIGS. 4*b* and 5*b* show corresponding sections on lines IV—IV and V—V in FIGS. 4*a* and 5*a*.

Figure 1:
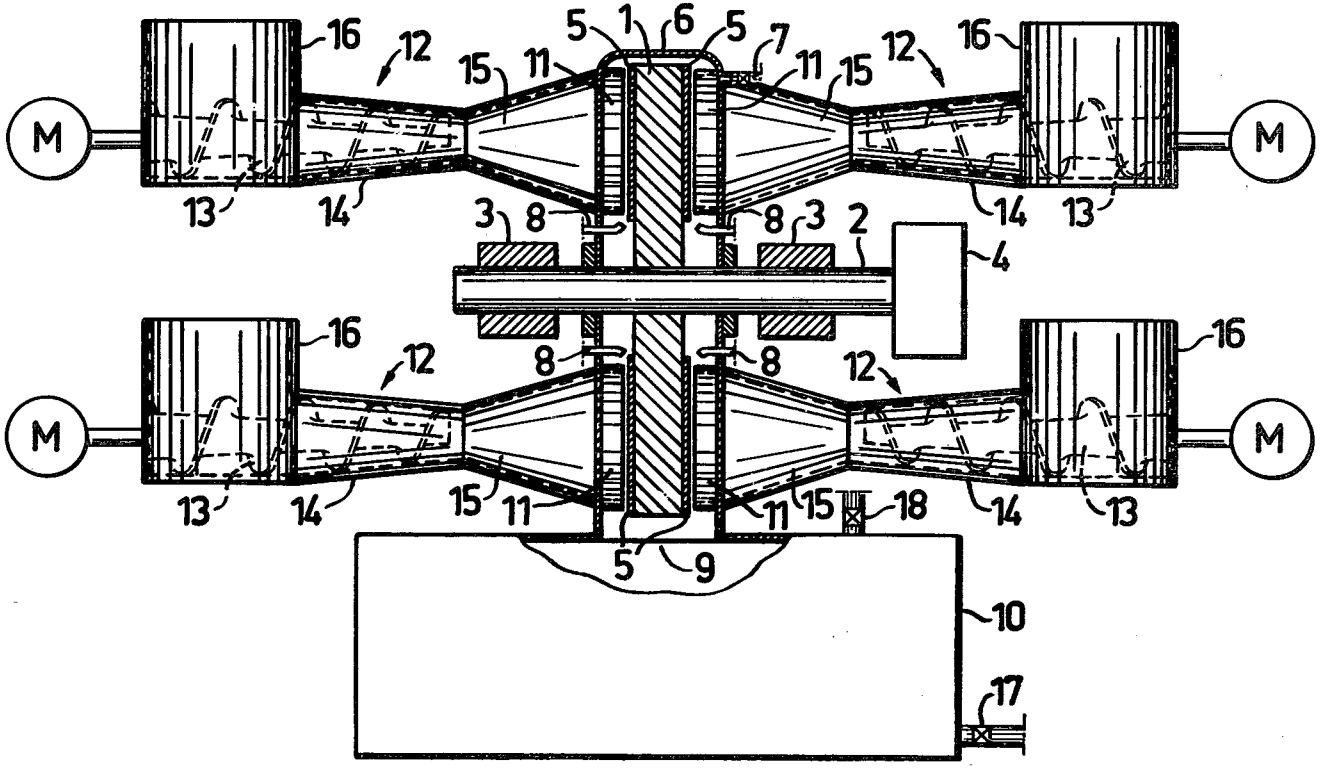
FIG. 1 shows a vertical section, in the axial plane, through a device for implementing the method of the invention.
Figure 2:
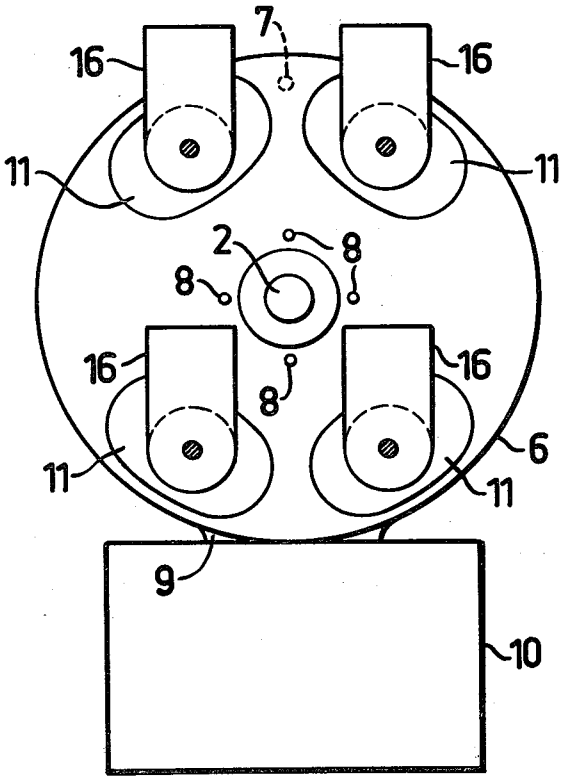
FIG. 2 shows a vertical elevation of the same, regarded in the axial direction.

As illustrated in FIGS. 1 and 2, a circular grinding disc 1 is mounted on a horizontal axle 2, which is supported in bearings 3 and caused to revolve by the motor 4. The bearings are also capable of absorbing axial thrust in both directions. Both the end faces of the grinding disc are provided with patterns 5 in the form of projections, such as illustrated in FIGS. 4*a* and 5*a*. The pattern is made of steel, cast iron, carbide, or other material with high resistance to abrasion.

The grinding disc is enclosed in a housing 6 with a steam inlet 7, eight water intakes 8, and an opening 9 in the bottom communicating with a pressure tank 10. The housing is moreover provided with openings for eight chip inlets 11, four located symmetrically opposite each of the two end faces of the grinding disc. To each chip intake there is connected a screw feeder 12 with a conical screw 13 which is mounted inside a conical screw pipe 14 and caused to rotate by a variable-speed motor M. The screw pipe passes into a plug pipe 15, which flares in the direction of feed in order to provide a larger grinding area, and discharges at the grinding surface 5 through the opening 11 in the housing.

The chips drop into the screw feeder via the chute 16 and are compressed as they are conveyed towards the grinding disc into a steamtight, continuous plug or short strand. The degree of compression depends on the conicity of the screw and the screw pipe. The plug of chips is heated and softened by the pressurized steam in the housing 6. When the chips come in contact with the projections on the grinding face 5 they are comminuted to fibre bundles, individual fibres and fibre fragments. These are diluted with hot water which is sprayed onto the grinding face through the inlets 8. The fibre-in-water suspension or stock is conveyed by centrifugal force towards the circumference of the grinding disc, where it is collected in the housing 6 and falls through the opening 9 into the pressure tank 10, whence it is blown through the valve 17 into the atmosphere. The pressure tank is also provided with a steam outlet with a valve 18 for drawing off any surplus steam. The stock then proceeds to further processing, comprising usually screening, vortex cleaning, and processing into paper, cardboard etc. in a well-known manner.

The desired pressure inside the housing is maintained by admitting steam through the intake 7. The pressure may be kept between 100 and 400–1,000 kPa absolute, the most suitable pressure being 150 to 250 kPa absolute, which corresponds to a temperature between 110° and 130° C. At this temperature the lignin in the wood bond softens, so that the fibres are freed in substantially undamaged condition. During grinding the chips are fixed with their fibres oriented in various directions, unlike the grinding of round timber, where the fibres are parallel to the grinding face, or chip refining, where the chips are free to move. This results in a short-fibred pulp with a higher content of fines. As remarked above, however, this can be an advantage for certain paper grades, and by mixing different types of pulp one can obtain a suitable combination of strength, printability etc. Moreover, the energy consumption required for the manufacture of a short-fibred pulp is considerably lower than that of a long-fibred pulp with maximum strength. However, the dimensions of the chips, which are longest in the direction of the fibres, will have the effect that when compressed and forced into contact with the disc the chips will "lie down", i.e., mainly assume an orientation with the fibres in the plane of the grinding disc. Hence the proportion of fibres ground while oriented perpendicular to the grindstone will be small. Hence the pulp will have a definitely fibrous character, although, as we have remarked, the mean fibre length will not be very great. An important factor for the retention of the fibrous structure is the pressurized steam atmosphere. The combination of high humidity and high temperature obtained thereby promotes the freeing of the fibres. Other factors affecting the quality of the pulp are the quantity of water added, the patterning of the disc, the speed of revolution of the disc, the pressure with which the plug of chips is forced against the grinding disc etc. The last-mentioned parameter is controlled by varying the speed of the screw feeders 12. When the speed of the screw is increased the contact pressure increases. The pulp is then coarser, i.e. the coarse and long fractions increase and the proportion of fines decreases. The resistance of the stock to dewatering is lower. At the same time, production increases and the load on the grinding motor is higher.

It is convenient to run all the screw feeders 12 at the same speed using a common speed control. If the fineness of the pulp is to be varied over a very wide range, either the power of the grinding motor will be poorly utilized when manufacturing the finest grades of pulp, or the motor will be overloaded when manufacturing the coarsest pulp grades. In the latter case some of the screw feeders may be shut down, but mutually opposed feeders should always be operated. By this means the grinding disc 1 will be axially balanced, which is a great advantage with regard to the load on the bearings and the deflection of the disc. It is important that the clearance between the inner end of the pipe delivering the plug of chips and the projections on the grinding disc is as small as possible, so that undefibred chip fragments cannot slip past and find their way into the stock. This clearance can be corrected for the wear of the grinding surface by making the inner part of the plug pipe 15 axially adjustable. This is facilitated in that the grinding surface is flat.

Figure 3:
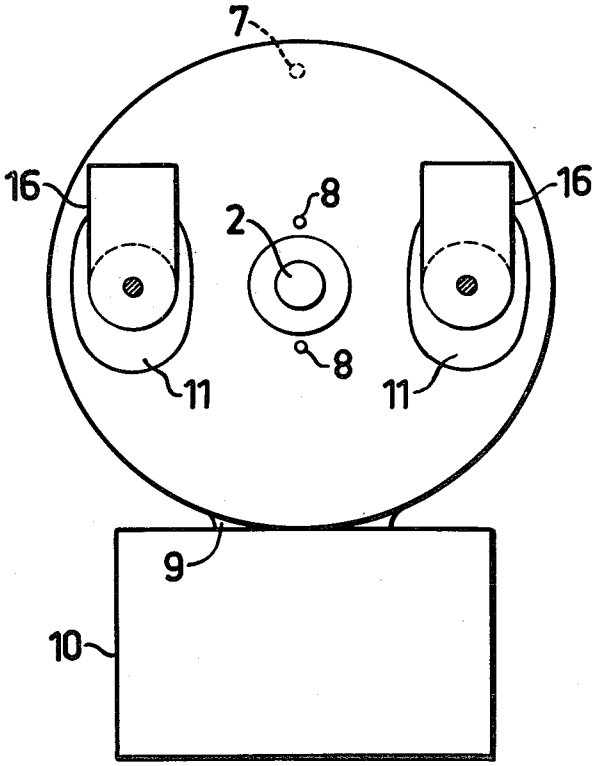
FIG. 3 is an elevation, similar to FIG. 2, of an alternative embodiment.

FIG. 3 illustrates an alternative embodiment with two feeders and chip inlets 11 instead of four opposite each of the flat end faces of the grinding disc. This design utilizes less of the available grinding surface but gives a simpler apparatus and is therefore suitable in case of low production capacities, for example. Moreover, the chips feed to the feed chutes is more simply arranged.

FIG. 4 shows a design for the patterning of the grinding disc, with raised ribs 20 running in a substantially radial direction. The comminution and processing of the wood substance is effected by these ribs, and primarily by their leading edges as the disc rotates. The grooves or channels 21 between the ribs convey the pulp, with the aid of centrifugal force, towards the circumference of the disc. FIG. 5 shows an alternative pattern with rectangular projections 22 instead of ribs, located along radii on the disc surface. The ribs or rectangular projections project at least 1–2 mm and preferably 3–5 mm out from the grinding surface. The patterned surface may be made in one piece but is preferably fabricated in the form of a number of plates which are mounted on the grinding disc and replaced when worn.

The above-mentioned embodiment of the method and the device can be modified in various ways. One, two, three or more grinding areas can be provided in various ways at one or both end faces of the disc. The particles of material may be fed to the grinding face in different ways. The means for retaining, compressing and maintaining contact pressure may be of another kind, e.g. pressure pistons or chains. The pressure in the housing can be maintained by a pressure medium other than steam, such as air or an inert gas. The grinding surface may be made, for example, of ceramic particles embedded in a binder. The stock may be discharged from the pressurized housing in various ways.

The material can be pretreated in various ways, e.g. by impregnation with chemicals of various kinds for softening the fibre bond, adjusting the acidity (pH) or for bleaching purposes. The chemicals may also be added directly in the grinding step, preferably dissolved in the dilution water. However, the material must not be broken down by chemical or mechanical means so that it loses its character of distinct particles with the approximate dimensions given below. This form of aggregate is necessary in order for the material to be retained during grinding, in contrast to the case of refining.

Thus, the invention is concerned with a method and a device for the manufacture of mechanical pulp from lignocellulosic material, wherein the material in bulk form, consisting of a large number of particles, usually wood chips, in the presence of water, is retained against and forced into contact with at least one grinding area on one or both end faces of a grinding disc, which revolves about an axle perpendicular to the end faces of the disc in a sealed, pressurized housing. A suitable particle size for the material to be used in implementing the invention is approx. 20–30 mm in length parallel to the fibres, approx. 10–20 mm in width, and approx. 5–10 mm in thickness, i.e. normal cellulose chips.

I claim:

1. Method for manufacturing mechanical pulp from lignocellulosic material by forcing the said material into contact with opposite end faces of a single grinding disc (1) which revolves about a central axle (2) perpendicular to said two opposite end faces of the disc, which method is characterized in that the material is separately fed in bulk, particulate form to each face, a large number of particles of the said material simultaneously being retained against, compressed and, in the presence of water, forced directly into contact with one or more grinding areas (5) located on each of said opposite end faces of said single grinding disc, the disc being enclosed in a sealed, pressurized housing (6).

2. Method according to claim 1, characterized in that the pressure in the housing (6) is maintained by means of steam.

3. Method according to claim 1, characterized in that the pressure in the housing (6) is maintained by air or by an inert gas.

4. Method according to claim 1, characterized in that the pressure inside the housing (6) is between 100 and 400 to 1000 kPa absolute.

5. Method according to claim 1, characterized in that the material is fed to the grinding disc (1) through one or more openings (11) in the housing (6) in the form of a continuous steam-tight plug or short strand.

6. Method according to claim 1, characterized in that the particles of the material, before or during grinding, are impregnated or otherwise exposed to chemicals to soften the fibre bond, to adjust the acidity (pH) or to increase the brightness.

7. Method according to claim 4, characterized in that the pressure inside the housing (6) is between 150 and 250 kPa to 1000 kPa absolute.

8. Method according to claim 1, characterized in that the material in particulate form is wood chips.

* * * * *

UNITED STATES PATENT OFFICE

CERTIFICATE OF CORRECTION

Patent No. 4,372,810 Dated February 8, 1983

Inventor(s) Hjalmar S. I. Bystedt

It is certified that error appears in the above-identified patent and that said Letters Patent are hereby corrected as shown below:

On the title page add the following:

[30] Foreign Application Priority Data

October 10, 1979 [SE] Sweden . . . . . 7908411-7

Signed and Sealed this

Sixteenth Day of October 1984

[SEAL]

Attest:

GERALD J. MOSSINGHOFF

Attesting Officer

Commissioner of Patents and Trademarks